US007550906B2

(12) United States Patent
Yoshimoto et al.

(10) Patent No.: US 7,550,906 B2
(45) Date of Patent: Jun. 23, 2009

(54) SPARK PLUG HAVING A NOBLE-METAL CHIP AND METHOD FOR MANUFACTURING THE SAME

(75) Inventors: Osamu Yoshimoto, Aichi (JP); Wataru Matsutani, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 481 days.

(21) Appl. No.: 11/071,202

(22) Filed: Mar. 4, 2005

(65) Prior Publication Data

US 2005/0200255 A1 Sep. 15, 2005

(30) Foreign Application Priority Data

Mar. 5, 2004 (JP) ..... 2004-061813

(51) Int. Cl.
*H01T 13/20* (2006.01)
*H01T 21/02* (2006.01)

(52) U.S. Cl. ..... 313/141; 313/142; 313/143; 445/7; 123/169 EL; 123/169 R

(58) Field of Classification Search ..... 313/135, 313/140–142, 144, 145
See application file for complete search history.

(56) References Cited

U.S. PATENT DOCUMENTS 4,331,899 A * 5/1982 Nishida et al. ..... 313/141
5,929,556 A * 7/1999 Matsubara et al. ..... 313/141
5,977,695 A 11/1999 Osumura et al.
6,046,532 A * 4/2000 Matsutani et al. ..... 313/141
6,064,143 A * 5/2000 Kagawa ..... 313/141
6,093,071 A 7/2000 Osumura et al.
6,094,000 A 7/2000 Osamura et al.
6,262,522 B1 7/2001 Osamura et al.
6,304,022 B1 * 10/2001 Matsutani ..... 313/141
6,307,307 B1 * 10/2001 Kanao ..... 313/142
6,470,845 B2 * 10/2002 Kanao ..... 123/169 EL
6,680,561 B2 * 1/2004 Yamaguchi et al. ..... 313/118
6,744,188 B2 * 6/2004 Nishikawa et al. ..... 313/141
2003/0038577 A1 * 2/2003 Hori et al. ..... 313/141
2003/0062815 A1 * 4/2003 Kanao et al. ..... 313/141
2003/0085643 A1 * 5/2003 Matsubara ..... 313/141

FOREIGN PATENT DOCUMENTS

JP 9-7733 1/1997
JP 9-92432 4/1997
JP 10-22053 1/1998
JP 10-032076 3/1998
JP 11-154583 8/1999
JP 2002-299005 10/2002

* cited by examiner

*Primary Examiner*—Sikha Roy
*Assistant Examiner*—Tracie Y Green
(74) *Attorney, Agent, or Firm*—Sughrue Mion, PLLC

(57) ABSTRACT

A noble-metal chip (30, 90) joined to at least either a center electrode or a ground electrode, the center and ground electrodes forming a spark discharge gap, and having a circumferential edge of its facing end surface (31, 91) removed so as to form an edge-removed portion (32, 92). The edge-removal length is 0.01 mm or more and a ratio of the edge-removal length to a radius of the noble-metal chip is less than 0.3. The noble-metal chip is made of iridium or an alloy that contains iridium man amount of 70% by weight or more, and crystal grains constituting the noble-metal chip (30, 90) extends in the axial direction. Also disclosed is a method for manufacturing the spark plug.

11 Claims, 4 Drawing Sheets

SPARK PLUG HAVING A NOBLE-METAL CHIP AND METHOD FOR MANUFACTURING THE SAME

BACKGROUND OF THE INVENTION

1. Field of the Invention

The present invention relates to a spark plug for an internal combustion engine having a noble-metal chip joined to an electrode adapted to perform spark discharge.

2. Description of the Related Art

Conventionally, spark plugs have been used for providing ignition in internal combustion engines. Such a spark plug generally includes a metallic shell that holds an insulator in which a center electrode is provided in an inserted condition, and a ground electrode whose one end portion is joined to a front end portion of the metallic shell and whose other end portion is opposed to a front end portion of the center electrode. The spark plug further includes a noble-metal chip for enhancing resistance to arc-induced erosion. The noble-metal chip is provided in either a region of the center electrode or a region of the ground electrode, the regions opposing each other.

Iridium is proposed as a material for such a noble-metal chip (refer to, for example, Patent Documents 1 and 2). Because of increasing demand for enhancing erosion resistance of spark plugs in recent years, iridium, whose melting point is higher than that of conventionally used platinum, is used as a material for noble-metal chips so as to enhance erosion resistance. Generally, such a noble-metal chip is formed into a cylindrical shape, and its one end surface (hereinafter, also referred to as a "proximal end surface") is joined to the center electrode or the ground electrode, whereas its other end surface (hereinafter, also referred to as a "facing end surface") is opposed to the center electrode or the ground electrode (in the case where a noble-metal chip is joined to each of the center electrode and the ground electrode, the noble-metal chips are opposed to each other), thereby forming a spark discharge gap therebetween.

[Patent Document 1] Japanese Patent Application Laid-Open (kokai) No. H09-7733

[Patent Document 2] Japanese Patent Application Laid-Open (kokai) No. H10-22053

3. Problems to be Solved by the Invention

Iridium-containing noble-metal chips are usually formed by the steps of mixing material powders; melting the resultant mixed powder; forming a billet from the molten metal; subjecting the billet to a rolling process and a forming process so as to form the billet into a rod; and cutting the rod into pieces having an appropriate length. The rolling process causes crystal grains of such a noble-metal chip to extend in the axial direction of the noble-metal chip. Accordingly, the crystal grains assume the form of fibers having a larger length along an axial direction of the noble metal chip than along a direction perpendicular to the axial direction, thereby exhibiting superb resistance against oxidation consumption.

However, since the crystal grains of a noble-metal chip have the form of fibers extending in the axial direction, the noble-metal chip is prone to cracking or chipping in the axial direction. Studies conducted by the present inventors have revealed that, when subjected to an external force, a noble-metal chip that contains iridium in an amount of 70% by weight or more does not readily absorb external force through deformation and is prone to cracking or chipping. When such cracking or chipping causes a reduction in the area of the distal (or facing) end surface, which partially forms a spark discharge gap of the noble-metal chip, spark discharge is concentrated on the remaining portion of the distal end surface. As a result, arc-induced erosion of the noble-metal chip is accelerated, and thus the spark discharge gap is prone to increase.

SUMMARY OF THE INVENTION

The present invention has been achieved in view of the above problems of the prior art, and an object of the invention is to provide a spark plug which exhibits reduced occurrence of cracking or chipping of a cylindrical iridium-containing noble-metal chip so as to enhance its durability.

The above objects have been achieved by providing, in accordance with a first aspect (1) of the invention, a spark plug which comprises a center electrode; an insulator having an axial hole, and holding the center electrode with a front end portion of the center electrode protruding from axial hole; a metallic shell holding the insulator therein; a ground electrode having a first end portion joined to the metallic shell and a second end portion opposed to a front end portion of the center electrode; and a cylindrical noble-metal chip having a proximal end surface joined to at least either the front end portion of the center electrode or the second end portion of the ground electrode, and a facing end surface opposite to the proximal end surface. In the spark plug, the noble-metal chip is made of iridium or an alloy that contains iridium in an amount of 70% by weight or more; crystal grains constituting the noble-metal chip have a length along the axial direction of the noble-metal chip that is longer than along a direction perpendicular to the axial direction; said noble metal chip having an edge-removed portion along a circumferential edge of said facing end surface of the noble-metal chip; an edge removal length of said edge-removed portion of 0.01 mm or more; and a ratio of the edge removal length to the radius of the noble-metal chip of less than 0.3.

In the spark plug of the invention, the cylindrical noble-metal chip is provided in either a region of the center electrode or a region of the ground electrode with its proximal end surface joined to the region, the center electrode and the ground electrode forming a spark discharge gap and the center electrode and ground electrode regions opposing each other. Also, a circumferential edge of the facing end surface, opposite the proximal end surface, of the noble-metal chip is removed to thereby form an edge-removed portion. Since the noble-metal chip is formed of iridium alone or an alloy that contains iridium in an amount of 70% by weight or more, when subjected to an external force, the noble-metal chip does not readily absorb such externally applied force through deformation. Furthermore, since crystal grains that constitute the noble-metal chip have a longer length along an axial direction of the noble metal chip than along a direction perpendicular to the axial direction, the noble-metal chip is prone to cracking or chipping in the axial direction. However, according to the present invention, the circumferential edge of the facing end surface of the cylindrical iridium-containing noble-metal chip is removed so as to form an edge-removed portion, to thereby disperse external force applied on a circumferential edge portion of the facing end surface and to avoid concentrating external force on a single point. Thus, the occurrence of cracking or chipping of the noble-metal chip can be suppressed. Therefore, arc-induced erosion and oxidation-induced erosion of the noble-metal chip can be reduced, thereby enhancing durability. Notably, the axial direction of the noble-metal chip is the direction of a straight line passing through and which is generally perpendicularly to the distal and proximal end surfaces of the noble-metal chip.

When the edge-removed portion of the noble-metal chip is such that the edge removal length is less than 0.01 mm, the above-mentioned effect is not obtained, indicating that the edge removal length is insufficient. Employing an edge removal length of 0.01 mm or more allows the noble-metal chip to disperse external force, if any, imposed on its circumferential edge portion, whereby occurrence of cracking or chipping of the noble-metal chip can be suppressed. The ratio of the edge removal length to the radius of the noble-metal chip is set to less than 0.3. When the ratio is 0.3 or greater, the area of the facing end surface becomes too small. As a result, spark discharge is prone to be concentrated on a certain region of the facing end surface, thereby increasing erosion of the region resulting in impaired durability. However, a ratio less than 0.3 allows the facing end surface to have a sufficient area, thereby enhancing durability of the noble-metal chip.

Preferably, the noble-metal chip has a diameter of 0.3 mm to 0.8 mm. A noble-metal chip diameter within this range allows for a reduced discharge voltage, so that ignition performance can be effectively enhanced. A noble-metal chip diameter of less than 0.3 mm may fail to enhance erosion resistance of the noble-metal chip of the spark plug. Meanwhile, a noble-metal chip having a diameter in excess of 0.8 mm is too large to yield the above-mentioned effect.

The noble-metal chip preferably has a Vickers hardness of 500 HV or higher. Thus, when subjected to external force, such noble-metal chip does not readily absorb the external force through deformation and is particularly prone to cracking or chipping of its circumferential edge portion. Application of the present invention to a noble-metal chip whose Vickers hardness is 500 HV or higher, as in the case of a preferred embodiment (2) can effectively reduce cracking or chipping. Thus, arc-induced erosion and oxidation-induced erosion of the noble-metal chip can be suppressed, thereby enhancing durability.

The edge-removed portion of the spark plug is preferably formed, in another preferred embodiment (3), by rounding the circumferential edge. The edge-removed portion can be formed by rounding or cutting the edge. Among them, a rounded edge-removed portion can efficiently prevent chipping or cracking of the edge and improve endurance against sparks or oxidation.

The spark plug of the invention according to yet another preferred embodiment (4) yields, in addition to that of (1) or (2), the following effect when the noble-metal chip contains platinum, ruthenium, or rhodium as a second component. As is well known, iridium has a high melting point, but is prone to oxidation-induced erosion at high temperature. Using a mixture of iridium, and platinum, ruthenium, or rhodium as a material for a noble-metal chip of a spark plug can provide a noble-metal chip having excellent erosion resistance.

In a second aspect, the present invention provides a method for producing a spark plug which comprises the steps of: elongating a noble-metal material made of iridium alone or an alloy that contains iridium in an amount of 70% by weight or more to obtain a wire material; cutting said wire material in a direction perpendicular to its axial direction to form a columnar noble metal chip; and joining either of said end surfaces of said noble metal chip to at least either the front end portion of the center electrode or the second end portion of the ground electrode. The noble-metal chip formed of iridium or the alloy that contains iridium in an amount of 70% by weight or more does not readily absorb an externally applied force through deformation. Furthermore, the noble metal material made of iridium alone or an iridium alloy is elongated to produce the noble-metal chip which is then joined to one or both of the center electrode and the ground electrode in such manner that the direction of elongation is aligned with the axial direction of the spark plug. For this reason, the noble-metal chip is prone to cracking or chipping. Therefore by means of a barrel process, an edge-removed portion is formed on the circumferential edge of the facing end surface of the columnar noble metal chip in such manner that the edge-removed length is 0.01 mm or more and that a ratio of the edge-removed length to the radius of the above-mentioned formed body is less than 0.3. As a result, concentration of external force applied to a single point of the circumferential edge can be avoided, and the incidence of cracking or chipping of the noble-metal chip can be reduced.

When the edge removal length of the edge-removed portion of the columnar noble metal chip is less than 0.01 mm, the above-mentioned effect is not adequately obtained, indicating that the edge removal length is insufficient. An edge removal length of 0.01 mm or more allows the noble-metal chip to disperse an external force, if any, applied to its circumferential edge portion, whereby occurrence of cracking or chipping of the noble-metal chip can be suppressed. The ratio of the edge removal length to the radius of the noble-metal chip is set to less than 0.3. When the ratio is 0.3 or greater, the flat area of the facing end surface of the noble-metal chip that remains after forming becomes too small. As a result, spark discharge is prone to be concentrated on a certain region of the facing end surface, thereby causing increased erosion of the region and resulting in impaired durability. On the contrary, a ratio of less than 0.3 allows the facing end surface to have a sufficient flat area, thereby enhancing durability of the noble-metal chip.

Figure 1:
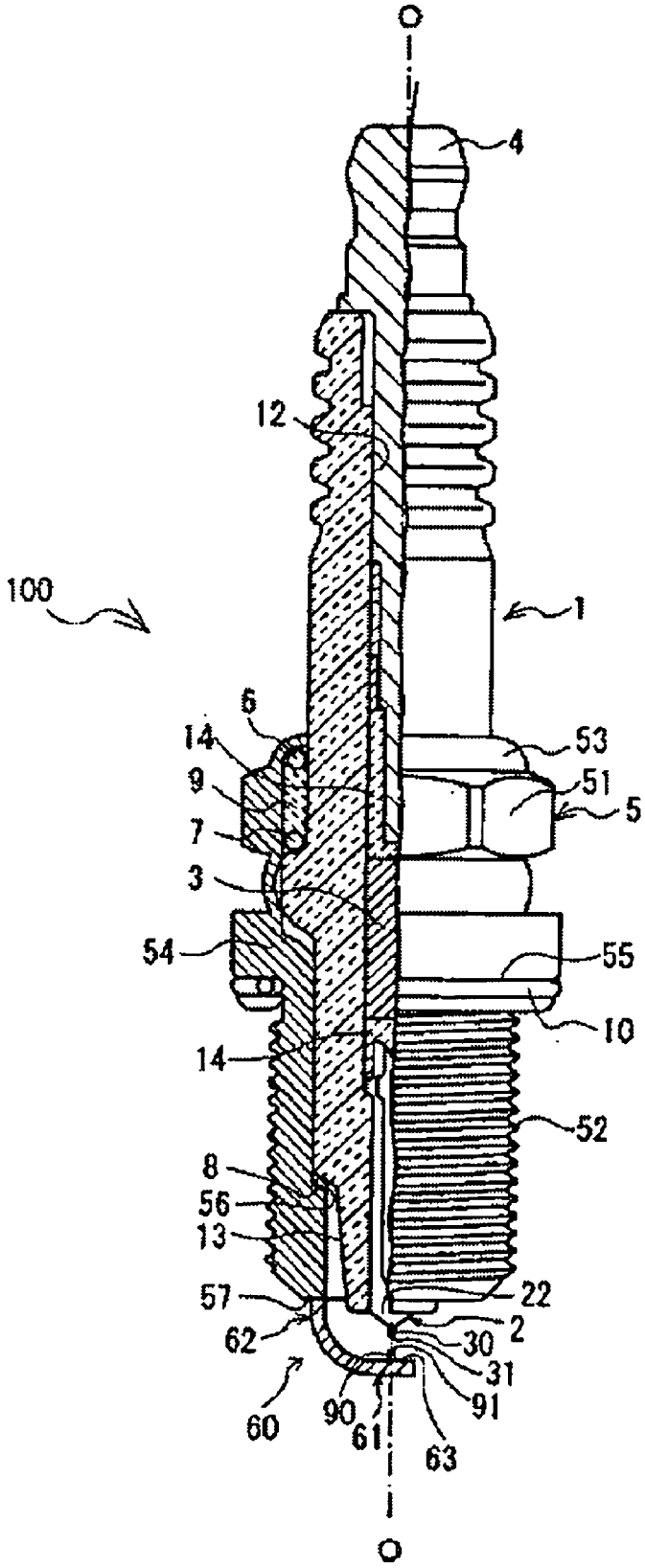
FIG. 1 is a partial sectional view of a spark plug 100.

Description of Reference Numerals: Reference numerals used to identify structural elements of the drawings include:

| | |
|---|---|
| 1: | insulator |
| 2: | center electrode |
| 5: | metallic shell |
| 12: | axial hole |
| 22: | front end portion |
| 60: | ground electrode |
| 61: | second end portion |
| 62: | first end portion |
| 30, 90: | noble-metal chip |
| 31, 91: | facing end surface |
| 32, 92: | edge-removed portion |
| 100: | spark plug |

DETAILED DESCRIPTION OF THE PREFERRED EMBODIMENTS

A spark plug according to an embodiment of the present invention will next be described with reference to the accompanying drawings. However, the present invention should not be construed as being limited thereto.

Figure 2:
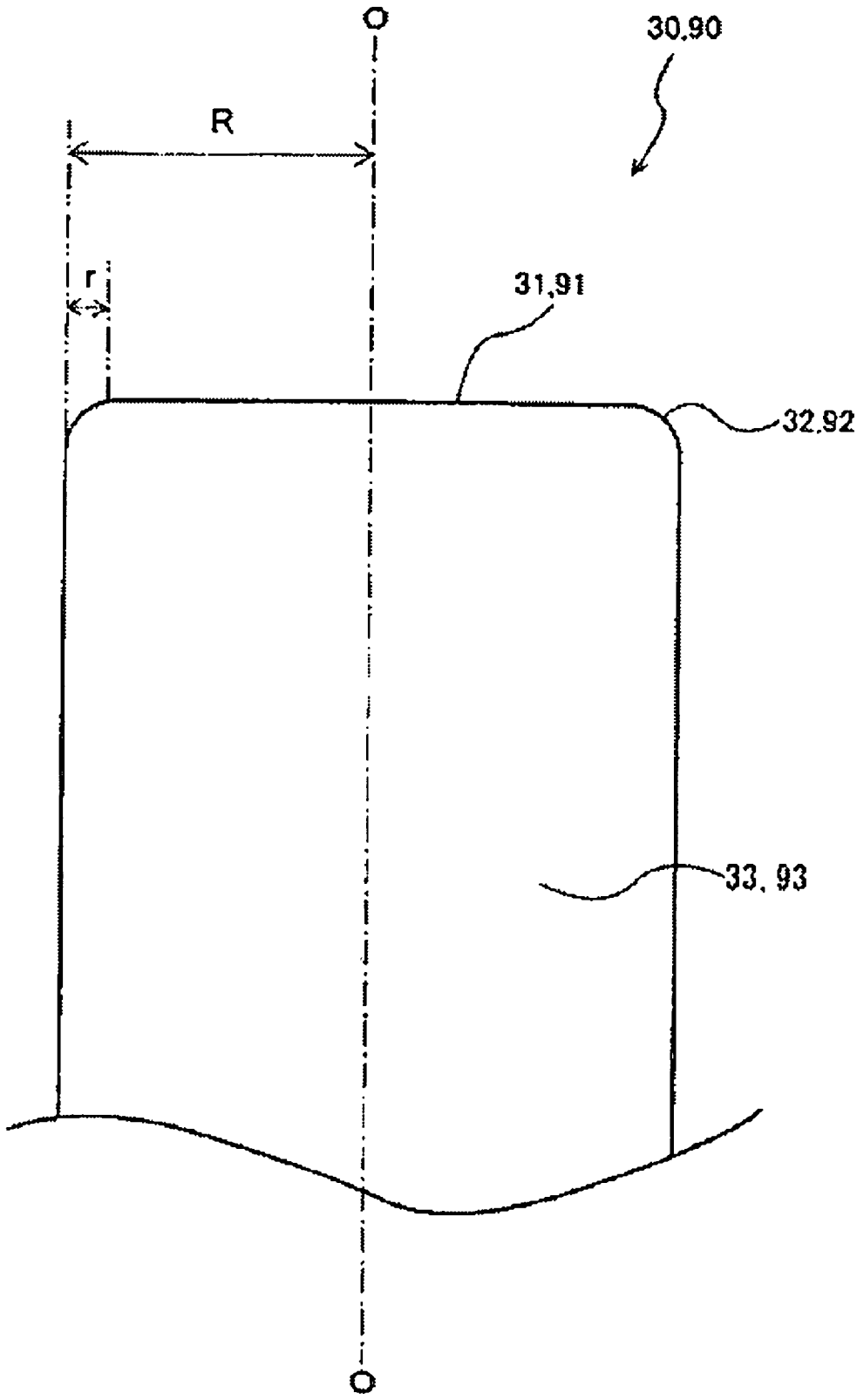
FIG. 2 is a sectional view of a front end portion of a noble-metal chip 30, 90.

First, the structure of a spark plug 100, which is the spark plug according to this embodiment, will be described with reference to FIGS. 1 and 2. FIG. 1 is a partial sectional view of the spark plug 100. FIG. 2 is a sectional view of a front end portion of a noble-metal chip 30, 90. Herein, with respect to the direction of an axis O (represented by the dot-and-dash line O in FIG. 1) shown in FIG. 1, a side toward a center electrode 2 is taken as a front end side of the spark plug 100, and a side toward a metallic terminal 4 is taken as a rear end side.

As shown in FIG. 1, the spark plug 100 includes an insulator 1; a metallic shell 5, which holds the insulator 1; the center electrode 2, which is held in the insulator 1 so as to extend in the direction of the axis O; a ground electrode 60, whose first end portion is welded to a front end surface 57 of the metallic shell 5 and whose second end portion is opposed to a front end portion 22 of the center electrode 2; and the metallic terminal 4, which is provided at an upper end portion of the insulator 1.

First, the insulator 1 of the spark plug 100 will be described. The insulator 1 assumes a tubular form and, as well known, is formed of alumina or the like by means of firing. A leg portion 13, which is positioned within a combustion chamber of an internal combustion engine, is provided at a front end portion (an end portion located toward the front end side with respect to the direction of the axis O) of the insulator 1. An axial hole 12 is formed in the insulator 1 so as to extend along the axis O.

The center electrode 2 is held in the axial hole 12 of the insulator 1 and is configured such that a copper core is covered with a surface layer of a nickel alloy, such as INCONEL (trade name) 600 or 601, or the like. The front end portion 22 of the center electrode 2 projects from the front end surface of the insulator 1 and is tapered such that the diameter is reduced toward the front end. A cylindrical noble-metal chip 30 is welded to the front end surface of the front end portion 22 by, for example, resistance welding or laser welding, so that its axis is aligned with the axis O of the center electrode 2. The center electrode 2 is electrically connected to the upper metallic terminal 4 via a seal member 14 and a resistor 3, which are provided in the axial hole 12. A high-voltage cable (not shown) is connected to the metallic terminal 4 via a plug cap (not shown), whereby high voltage is applied to the metallic terminal 4 from an external circuit.

Next, the metallic shell 5 will be described. The metallic shell 5 is adapted to hold the insulator 1 and to fix the spark plug 100 to an unillustrated internal combustion engine. The metallic shell 5 holds the insulator 1 in a surrounding condition. The metallic shell 5 is formed of low-carbon steel and includes a tool engagement portion 51, with which an unillustrated spark plug wrench is engaged, and a male-threaded portion 52, which is screw-engaged with an engine head provided at an upper portion of the unillustrated internal combustion engine.

The metallic shell 5 further includes a crimp portion 53, which is located on the rear end side of the tool engagement portion 51. Crimping the crimp portion 53 causes the insulator 1 to be supported on a stepped portion 56 via a sheet packing 8, whereby the metallic shell 5 and the insulator 1 are united together. In order to ensure sealing by crimping, ring members 6 and 7 intervene between the metallic shell 5 and the insulator 1. Talc 9 in the form of a powder fills a space between the ring members 6 and 7. A flange portion 54 is formed at a central portion of the metallic shell 5. A gasket 10 (an annular packing formed by folding a sheet) is fitted onto a seat surface 55 of the flange portion 54 by insertion, the seat surface 55 being located on the rear end side of the male-threaded portion 52.

Next, the ground electrode 60 will be described. The ground electrode 60 is formed of a metal having a high corrosion resistance; for example, a nickel alloy, such as INCONEL (trade name) 600 or 601. The ground electrode 60 has a substantially rectangular cross section taken perpendicular to its longitudinal direction. A first end portion 62 of the ground electrode 60 is joined (connected) to the front end surface 57 of the metallic shell 5 by welding. A second end portion 61 of the ground electrode 60 is bent so as to face the front end portion 22 of the center electrode 2. The noble-metal chip 90 is joined to the second end portion 61 by, for example, resistance welding or laser welding. An inner surface 63 of the second end portion 61 of the ground electrode 60 is opposed to the center electrode 2 and is substantially orthogonal to the axis O of the center electrode 2. A facing end surface 91 of the cylindrical noble-metal chip 90, which is provided on the inner surface 63 of the ground electrode 60 in a protruding condition, is opposed to a facing end surface 31 of the noble-metal chip 30 of the center electrode 2, thereby forming a spark discharge gap therebetween.

Next, the noble-metal chips 30 and 90 will be described with reference to FIG. 2. Since the noble-metal chip 30 and the noble-metal chip 90 are of a similar configuration except for dimensions, the noble-metal chips 30 and 90 will be described with reference to the same drawing. The noble-metal chip 30, 90 is formed of an alloy that contains iridium, which has excellent erosion resistance, in an amount of 70% by weight or more, and platinum, ruthenium, or rhodium as a second component. Specifically, the noble-metal chip 30, 90 is formed of Ir-5% by weight Pt, Ir-11% by weight to 8% by weight Rh-1% by weight Ni, or Ir-20% by weight Rh. As shown in FIG. 2, the circumferential edge of the facing end surface 31, 91 of the cylindrical noble-metal chip 30, 90; i.e., a dihedral-angle portion formed by the facing end surface 31, 91 and a circumferential side surface 33, 93, is rounded or chamfered to thereby form an edge-removed portion 32, 92. In the present embodiment, the edge removal length is 0.01 mm or more and the ratio of the edge removal length (r) to the radius of the facing end surface (R) of the noble-metal chip 30, 90 is less than 0.3. Notably, when a portion beveled or curved by removing an edge from a dihedral-angle portion is projected on a plane in parallel with either plane of the dihedral-angle portion, the length of the beveled or curved portion as measured on the plane is defined as the edge removal length. For example, in the case of projection on a plane in parallel with the facing end surface 31, 91 of the noble-metal chip 30, 90, the edge removal length is the length (indicated by r in FIG. 2) of the edge-removed portion 32, 92 as measured in a radial direction of the projected facing end surface 31, 91. As described above, in the cylindrical iridium-containing noble-metal chip 30, 90, a circumferential edge portion of the facing end surface 31, 91 is formed into the edge-removed portion 32, 92, thereby reducing occurrence of cracking or chipping of the noble-metal chip. Thus, durability can be enhanced.

The noble-metal chip 30, 90 of the present embodiment is configured such that its diameter is 0.3 mm to 0.8 mm, to thereby lower the discharge voltage and enhance ignition performance.

Figure 3:
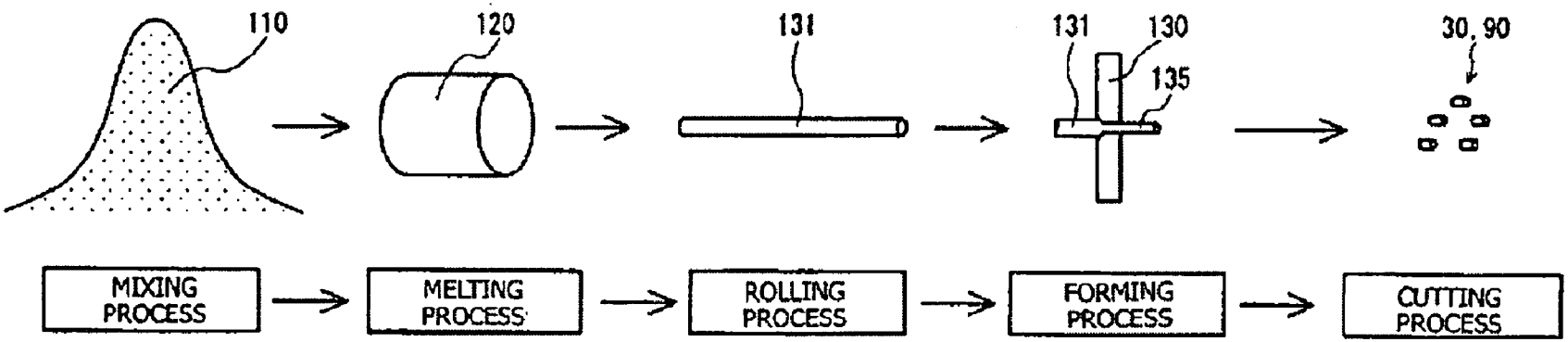
FIG. 3 is a schematic view showing an exemplary method for producing the noble-metal chip 30, 90.
Figure 4:
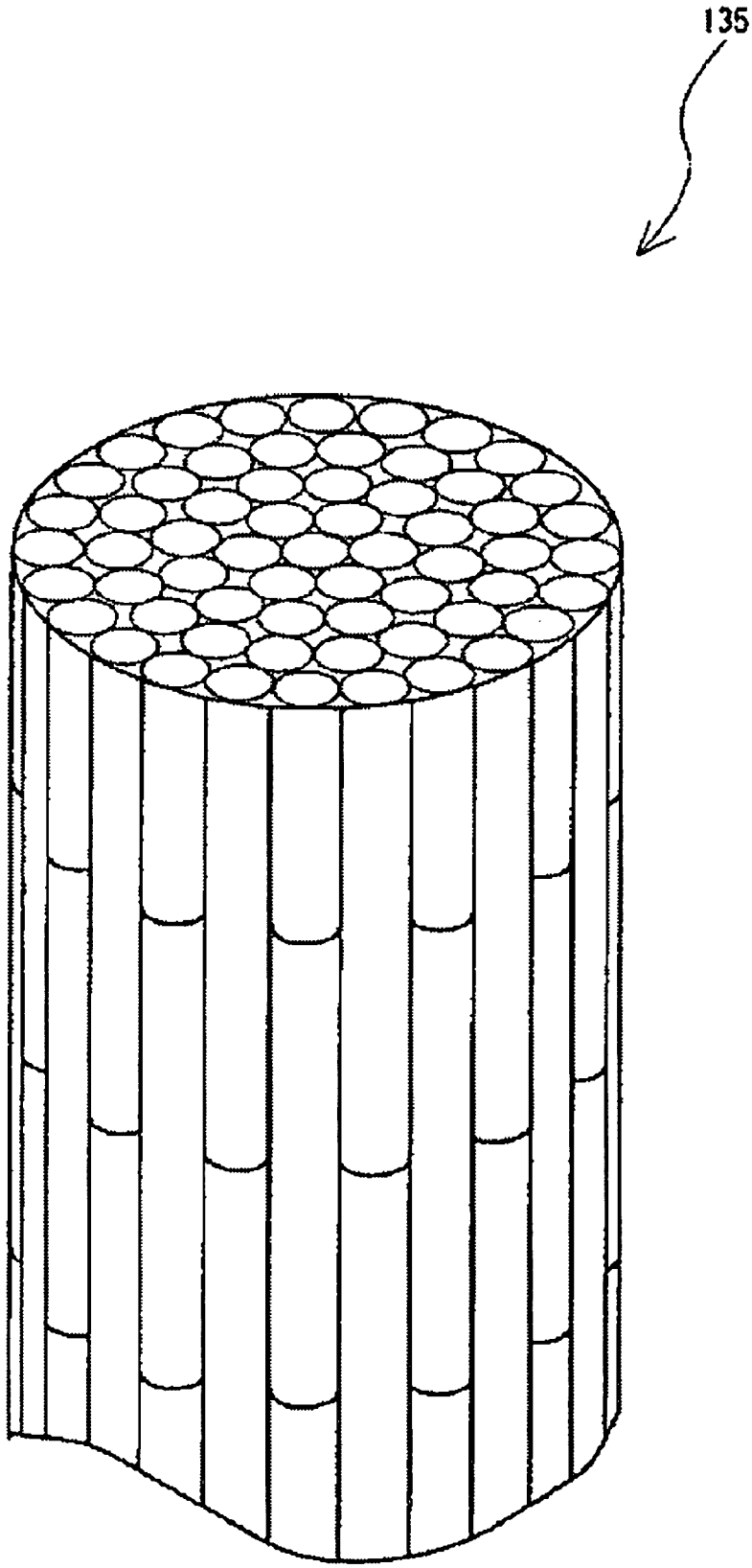
FIG. 4 is a schematic view showing an example microstructure of the noble-metal chip 30, 90.

A method for producing the noble-metal chip 30, 90 used in the spark plug 100 having the above-described configuration will next be described with reference to FIGS. 3 and 4. FIG. 3 schematically shows an example method for producing the noble-metal chip 30, 90. FIG. 4 schematically shows an example of the microstructure of the noble-metal chip 30, 90.

The noble-metal chip 30, 90 of the present embodiment is produced in the following manner. As shown in FIG. 3, at least one of platinum, ruthenium, and rhodium is mixed as a second component with iridium, which is a main component of the noble-metal chip 30, 90, and, as needed, another component (nickel, palladium, tungsten, or the like) is further added, thereby preparing a material powder 110 (mixing process). Next, the material powder 110 is melted in a melting furnace, and a billet 120 is obtained from the molten metal (melting process). The billet 120 is rolled so as to extend in the axial direction, thereby obtaining a material rod 131 (see FIG. 4)(rolling process). The material rod 131 is drawn through a hole of a wire-drawing die 130, to thereby obtain a material wire 135 having a circular cross section and a diameter of 0.3 mm to 0.8 mm (forming process). The material wire 135 is cut into pieces each having a predetermined length. The pieces are subjected to edge removal, which removes edges from opposite ends of each piece by use of a barrel (not shown). As a result, the cylindrical noble-metal chips 30, 90 having edge-removed portions 32, 92 (see FIG. 2) are obtained (cutting process).

Crystal grains that constitute the thus-formed noble-metal chip 30, 90 (i.e., crystal grains of a metal that contains iridium as a main component) assume the form of fibers extending in the axial direction as shown in FIG. 4. The form of fibers has been imparted to the crystal grains in the course of forming the drawn material 135 by the rolling and forming processes shown in FIG. 3. Thus, the noble-metal chip 30, 90 can exhibit superb mechanical characteristics in terms of toughness and strength, but is prone to cracking or chipping in the direction of the fibers; i.e., the axial direction along which the crystal grains extend. Particularly, when an external force is applied to a dihedral-angle portion of the noble-metal chip 30, 90, susceptibility to cracking or chipping increases. In order to lower the possibility of cracking or chipping, the edge-removed portion 32, 92 is formed in the present embodiment. The formation of the edge-removed portion 32, 92 can effectively lower the occurrence of cracking or chipping of the noble-metal chip, thereby enhancing durability.

EXAMPLE 1

In order to confirm the effect of the edge-removed portion 32, 92 in terms of reduced occurrence of cracking or chipping, the relationship between the radius R of the noble-metal chip 30, 90 and the edge removal length r of the edge-removed portion 32, 92 was studied. First, as shown in Table 1 below, the relationship between the edge removal length r and the incidence of cracking or chipping was evaluated. The evaluation was conducted as follows. The noble-metal chip 30 was joined to the center electrode 2, and then the center electrode 2 was inserted into the insulator 1. The insulator that held the center electrode was slid down on a 70-degree slope from a height of 30 cm with its front end facing downward, so that the noble-metal chip 30 hit the landing surface. The test was conducted on 1,000 samples each of combinations of the size (diameter×height mm) of the noble-metal chip 30 and the edge removal length (r mm). When cracking or chipping occupies 10% or more of the area of the facing end surface 31 of the noble-metal chip 30, the noble-metal chip 30 was considered to suffer from cracking or chipping. On the basis of this criterion, the incidence of cracking or chipping was determined. Notably, occupation of 10% or more of the area of the facing end surface 31 of the noble-metal chip 30 by cracking means that, when the cracked facing end surface 31 is viewed from above, a region of smaller area of two regions into which the facing end surface 31 is divided by cracking occupies 10% or more of the area of the facing end surface 31. In this case, the area of the facing end surface 31 is that of the facing end surface before an edge-removed portion is formed, and is calculated from the diameter of the noble-metal chip 30.

The samples whose noble-metal chips 30 had a diameter of 0.6 mm (radius 0.3 mm) and a height of 0.8 mm and included the respective edge-removed portions 32 having an edge removal length r of 0.005 mm, 0.01 mm, 0.02 mm, 0.08 mm, and 0.1 mm exhibited an incident of cracking or chipping of 15.0%, 1.0%, 0.4%, 0.5%, and 0.1%, respectively. The samples whose noble-metal chips 30 had a diameter of 0.4 mm (radius 0.2 mm) and a height of 0.6 mm and included the respective edge-removed portions 32 having an edge removal length r of 0.005 mm, 0.01 mm, 0.02 mm, 0.08 mm, and 0.1 mm exhibited an incident of cracking or chipping of 20.0%, 3.0%, 0.6%, 0.5%, and 0.3%, respectively. The samples whose noble-metal chips 30 had a diameter of 0.7 mm (radius 0.35 mm) and a height of 0.5 mm and included the respective edge-removed portions 32 having an edge removal length r of 0.005 mm, 0.01 mm, 0.02 mm, 0.05 mm, 0.08 mm, and 0.1 mm exhibited an incident of cracking or chipping of 13.0%, 0.9%, 0.3%, 0.3%, 0.1%, and 0.0%, respectively.

TABLE 1

| NOBLE-METAL CHIP SIZE (D × H) | EDGE REMOVAL LENGTH r | INCIDENCE OF CRACKING OR CHIPPING |
|---|---|---|
| ϕ 0.6 × 0.8 mm | 0.005 mm | 15.0% |
| | 0.01 mm | 1.0% |
| | 0.02 mm | 0.4% |
| | 0.08 mm | 0.5% |
| | 0.1 mm | 0.1% |
| ϕ 0.4 × 0.6 mm | 0.005 mm | 20.0% |
| | 0.01 mm | 3.0% |
| | 0.02 mm | 0.6% |
| | 0.08 mm | 0.5% |
| | 0.1 mm | 0.3% |
| ϕ 0.7 × 0.5 mm | 0.005 mm | 13.0% |
| | 0.01 mm | 0.9% |
| | 0.02 mm | 0.3% |
| | 0.05 mm | 0.3% |
| | 0.08 mm | 0.1% |
| | 0.1 mm | 0.0% |

The above test results reveal that increasing the edge removal length tends to lower the incidence of cracking or chipping. As the edge removal length increases, the ratio of a dihedral-angle portion of the noble-metal chip 30 formed by the facing end surface 31 and the circumferential side surface 33 to the entire noble-metal chip 30 is lowered. In other words, from the viewpoint of the entire noble-metal chip 30, as the edge removal length increases, the edge-removed portion 32 constitutes less of the dihedral-angle portion. Even when an external force is applied to the noble-metal chip 30, the external force is dispersed, so that cracking or chipping becomes unlikely to occur. An edge removal length of 0.01 mm or more suppresses the incidence of cracking or chipping to 3% or less.

EXAMPLE 2

Next, as shown in Table 2 below, the noble-metal chips were evaluated for arc-induced erosion in relation to whether or not cracking or chipping is present on the noble-metal chips. Among the spark plugs 100 which were evaluated in Example 1 and to which the noble-metal chips 30 having the size and the edge removal length shown in Tale 2 are joined, those that suffered from cracking or chipping and those that were free from cracking or chipping were selected at random. The thus-selected spark plugs 100 were evaluated. In a nitrogen atmosphere having a pressure of 0.4 MPa, spark discharge was conducted at a spark frequency of 60 Hz for 200 hours. After the test, the amount (length mm) of an increase in spark discharge gap was measured as compared with the spark discharge gap before the test.

Among the spark plugs 100 whose noble-metal chips 30 had a diameter of 0.6 mm (radius 0.3 mm), a height of 0.8 mm, and an edge removal length r of 0.005 mm, those whose noble-metal chips 30 were free from cracking or chipping and those whose noble-metal chips 30 suffered from cracking or chipping exhibited an increase in spark discharge gap of 0.02 mm and 0.10 mm, respectively, as measured after the test. Among the spark plugs 100 whose noble-metal chips 30 had a diameter of 0.6 mm (radius 0.3 mm), a height of 0.8 mm, and an edge removal length r of 0.08 mm, those whose noble-metal chips 30 were free from cracking or chipping and those whose noble-metal chips 30 suffered from cracking or chipping exhibited an increase in spark discharge gap of 0.03 mm and 0.11 mm, respectively, as measured after the test. Among the spark plugs 100 whose noble-metal chips 30 had a diameter of 0.7 mm (radius 0.35 mm), a height of 0.5 mm, and an edge removal length r of 0.005 mm, those whose noble-metal chips 30 were free from cracking or chipping and those whose noble-metal chips 30 suffered from cracking or chipping exhibited an increase in spark discharge gap of 0.01 mm and 0.09 mm, respectively, as measured after the test.

TABLE 2

| NOBLE-METAL CHIP SIZE (D × H) | EDGE REMOVAL LENGTH r | UNCRACKED | CRACKED |
|---|---|---|---|
| ϕ 0.6 × 0.8 mm | 0.005 mm | 0.02 mm | 0.10 mm |
| | 0.08 mm | 0.03 mm | 0.11 mm |
| ϕ 0.7 × 0.5 mm | 0.005 mm | 0.01 mm | 0.09 mm |

The above test results reveal that those noble-metal chips 30 suffering from cracking or chipping have impaired durability against spark discharge and are prone to erosion. This is because the spark discharge is concentrated on a dihedral-angle portion that has emerged at the position of cracking or chipping, causing susceptibility to erosion. It has also been confirmed that subjecting the noble-metal chip 30 to edge removal does not influence durability against spark discharge.

EXAMPLE 3

Next, as shown in Table 3 below, the noble-metal chips were evaluated as to relationship between the size of their distal end surface and edge removal length. The evaluation was conducted as follows: spark discharge was activated 500 times in an air atmosphere at a pressure of 0.6 MPa. The spark discharge gap was set to 1.05 mm. As in the case of Example 1, the test was conducted on 50 samples each of combinations of the size (herein radius R, in mm) of the noble-metal chip 30 and the edge removal length (r, in mm). When the average value of measured discharge voltages was less than 12 KV, the group was evaluated as being "excellent" and marked with "o" in Table 3; when the average value was 12 KV or greater and less than 15 KV, the group was evaluated as being "good" and marked with "*"; and when the average value was 15 KV or greater, the group was evaluated as being "defective" and marked with "x."

Those samples whose noble-metal chips 30 had a radius of 0.3 mm (diameter 0.6 mm, height 0.8 mm) and included the respective edge-removed portions 32 having an edge removal length r of 0.005 mm, 0.01 mm, 0.02 mm, 0.07 mm, 0.08 mm, 0.09 mm, and 0.1 mm were evaluated as o, o, o, o, Δ, x and x, respectively. In the noble-metal chips 30 of the samples, the ratios of the edge removal length r to the radius R of the facing end surface 31; i.e., the ratios r/R between the edge removal length r and the radius R, were 0.017, 0.033, 0.067, 0.233, 0.267, 0.300, and 0.333, respectively. Similarly, the samples whose noble-metal chips 30 had a radius of 0.2 mm (diameter 0.4 mm, height 0.6 mm) and included the respective edge-removed portions 32 having an edge removal length r of 0.005 mm, 0.01 mm, 0.04 mm, 0.05 mm, 0.06 mm, and 0.08 mm were evaluated as o, o, o, Δ, x and x, respectively. In the samples, the ratios r/R between the edge removal length r and the radius R were 0.025, 0.050, 0.200, 0.250, 0.300, and 0.400, respectively.

TABLE 3

| EDGE REMOVAL LENGTH r | RADIUS R OF NOBLE-METAL CHIP | r/R | DISCHARGE VOLTAGE |
|---|---|---|---|
| 0.005 mm | 0.3 mm | 0.017 | ○ |
| 0.01 mm | (ϕ 0.6 × 0.6 mm) | 0.033 | ○ |
| 0.02 mm | | 0.067 | ○ |
| 0.07 mm | | 0.233 | ○ |
| 0.08 mm | | 0.267 | Δ |
| 0.09 mm | | 0.300 | x |
| 0.1 mm | | 0.333 | x |
| 0.005 mm | 0.2 mm | 0.025 | ○ |
| 0.01 mm | (ϕ 0.4 × 0.6 mm) | 0.050 | ○ |
| 0.04 mm | | 0.200 | ○ |
| 0.05 mm | | 0.250 | Δ |
| 0.06 mm | | 0.300 | x |
| 0.08 mm | | 0.400 | x |

○: LESS THAN 12 KV
Δ: 12 KV TO 15 KV (NOT INCLUDED)
x: 15 KV OR MORE

The above test results reveal that, when the ratio r/R between the edge removal length r and the radius R becomes 0.3 or greater, the discharge voltage increases. The area of the facing end surface 31 of the noble-metal chip 30 decreases, and thus the discharge area decreases. Accordingly, spark discharge is concentrated on a certain region, and erosion of the region is intensified. As a result, the spark discharge gap is prone to increase, potentially resulting in impaired durability. Therefore, the ratio r/R between the edge removal length r and the radius R is desirably less than 0.3. More preferably, the ratio r/R is less than 0.25, because the discharge voltage can be less than 12 KV.

EXAMPLE 4

Finally, as shown in Table 4 below, the relationship between Vickers hardness of the noble-metal chips and the incidence of cracking or chipping was evaluated. The evaluation was conducted as follows: the drop test of Example 1 was conducted on samples whose noble-metal chips 30 differed in Vickers hardness and were subjected to edge removal and those whose noble-metal chips 30 differed in Vickers hardness and were not subjected to edge removal. The evaluation method of Example 1 was also used.

Four kinds of noble-metal chips 30 (diameter 0.6 mm, height 0.8 mm) on which the edge-removed portion 32 having an edge removal length of 0.005 mm was formed and which had a Vickers hardness of 490 HV, 505 HV, 530 HV, and 600 HV exhibited an incidence of cracking or chipping of 10.0%, 13.0%, 15.0%, and 17.0%, respectively. Four kinds of noble-metal chips 30 (diameter 0.6 mm, height 0.8 mm) on which the edge-removed portion 32 having an edge removal length of 0.02 mm was formed and which had a Vickers hardness of 490 HV, 505 HV, 530 HV, and 600 HV exhibited an incidence of cracking or chipping of 0.8%, 0.6%, 0.4%, and 0.2%, respectively.

TABLE 4

| NOBLE-METAL CHIP SIZE (D × H) | EDGE REMOVAL LENGTH r | VICKERS HARDNESS | INCIDENCE OF CRACKING OR CHIPPING |
|---|---|---|---|
| ϕ 0.6 × 0.8 mm | 0.005 | 490 HV | 10.0% |
| | | 505 HV | 13.0% |
| | | 530 HV | 15.0% |
| | | 600 HV | 17.0% |
| | 0.02 | 490 HV | 0.8% |
| | | 505 HV | 0.6% |
| | | 530 HV | 0.4% |
| | | 600 HV | 0.2% |

The above test results reveal that, in the case of the noble-metal chips 30 which were not subjected to edge removal, as hardness increases, cracking or chipping is more prone to occur. This is because a noble-metal chip of lower hardness can disperse and absorb an externally applied force through deformation. However, subjecting the noble-metal chip 30 to edge removal lowers the incidence of cracking or chipping. Particularly, at a Vickers hardness in excess of 500 HV, the effect of edge removal manifested itself significantly. In other words, by avoiding concentration of an externally applied force on a single point by means of edge removal allows a noble-metal chip having higher hardness to be less prone to cracking or chipping.

In the above Examples 1 to 4, a noble-metal chip 30 joined to the center electrode 2 was evaluated. A chip similar to the noble-metal chip 30 may be used as the noble-metal chip 90 joined to the ground electrode 60.

The present invention is not limited to the above-described embodiment, but may be embodied in various other forms. For example, the edge-removed portion 32, 92 is formed by rounding in the present embodiment, but may also be formed by chamfering. The noble-metal chip 30 is provided on the center electrode 2, and the noble-metal chip 90 is provided on the ground electrode 60. However, a noble-metal chip may be provided on either the center electrode 2, or the ground electrode 60, or both. In the present embodiment, edge removal is performed on the opposite end surfaces of the noble-metal chip 30 by use of a barrel. However, edge removal may be performed on either of the opposite end surfaces. In this case, the end surface on which edge removal is not performed is joined to the center electrode or ground electrode.

While the invention has been described in detail and with reference to specific embodiments thereof, it will be apparent to one skilled in the art that various changes and modifications can be made therein without departing from the spirit and scope thereof.

This application is based on Japanese Patent Application No. 2004-61813 filed Mar. 5, 2004, incorporated herein by reference in its entirety.

What is claimed is:

1. A spark plug comprising:

a center electrode;

an insulator having an axial hole, and holding the center electrode with a front end portion of the center electrode protruding from the axial hole;

a metallic shell holding the insulator therein;

a ground electrode having a first end portion joined to the metallic shell and a second end portion opposed to a front end portion of the center electrode; and a cylindrical noble-metal chip having a proximal end surface joined to at least either the front end portion of the center electrode or the second end portion of the ground electrode, and a facing end surface opposite the proximal end surface, wherein the noble-metal chip is made of iridium or an alloy that contains iridium in an amount of 70% by weight or more, and crystal grains constituting the noble-metal chip are longer in length along an axial direction of the noble-metal chip than along a direction perpendicular to the axial direction;

said noble metal chip having an edge-removed portion along a circumferential edge of said facing end surface, an edge removal length of 0.01 mm or more, and a ratio of the edge removal length to a radius of the noble-metal chip of less than 0.3.

2. The spark plug according to claim 1, wherein the noble-metal chip has a Vickers hardness of 500 HV or higher.

3. The spark plug according to claim 1, wherein said edge-removed portion is formed by rounding said circumferential edge.

4. The spark plug according to claim 2, wherein said edge-removed portion is formed by rounding said circumferential edge.

5. The spark plug according to claim 1, wherein the noble-metal chip is formed of an alloy that contains platinum, ruthenium, or rhodium as a second component.

6. The spark plug according to claim 2, wherein the noble-metal chip is formed of an alloy that contains platinum, ruthenium, or rhodium as a second component.

7. The spark plug according to claim 3, wherein the noble-metal chip is formed of an alloy that contains platinum, ruthenium, or rhodium as a second component.

8. A method forproducing a spark plug, said spark plug comprising: a center electrode; an insulator having an axial hole, and holding the center electrode with a front end portion of the center electrode protruding from the axial hole; a metallic shell holding the insulator therein; a ground electrode having a first end portion joined to the metallic shell and a second end portion opposed to a front end portion of the center electrode; and a cylindrical noble-metal chip having a proximal end surface joined to at least either the front end portion of the center electrode or the second end portion of the ground electrode, and a facing end surface opposite theproxlinalend surface, wherein the noble-metal chip is made of iridium or an alloy that contains iridium in an amount of 70% by weight or more, and crystal grains constituting the noble-metal chip are longer in length along an axial direction of the noble-metal chip than along a direction perpendicular to the axial direction;

said noble-metal chip having an edge-removed portion along a circumferential edge of said facing end suiface, an edge-removal length of 0.01 mm or more, and a ratio of the edge removal length to a radius of the noble-metal chip of less than 0.3;

said method comprising:

elongating a noble-metal material made of iridium or an alloy that contains iridium in an amount of 70% by weight ormore to obtain a wire material;

cutting said wire material in a direction perpendicular to its axial direction to form a columnar noble metal chip;

removing a circumferential edge of an end surface of said noble metal chip to form an edge-removed portion having an edge removal length of 0.01 mm or more and a ratio of the edge removal length to a radius of the noble-metal chip of less than 0.3; and joining a proximal end surface of said noble metal chip to at least either the front end portion of the center electrode or the second end portion of the ground electrode so that a facing end surface opposite the proximal end surface has an edge-removed portion.

9. The method according to claim 8, which comprises removing circumferential edges of both end surfaces of said noble metal chip.

10. The method according to claim 9, wherein said removing comprises barrel finishing.

11. The spark plug according to claim 1, wherein the cylindrical noble-metal chip is joined to the front end portion of the center electrode.

* * * * *